United States Patent [19]

Noé et al.

[11] 3,989,202

[45] Nov. 2, 1976

[54] APPARATUS FOR WINDING AND UNWINDING A BAND

[75] Inventors: Oskar Noé; Heinz Wilhelm Berger, both of Mulheim (Ruhr), Germany

[73] Assignee: BGW Bergwerk-und Walzwerk Maschinenbau G.m.b.H., Duisburg, Germany

[22] Filed: Oct. 16, 1975

[21] Appl. No.: 622,979

[30] Foreign Application Priority Data

June 21, 1975 Germany ..... 2527690

[52] U.S. Cl. ..... 242/72 R; 242/68.1

[51] Int. Cl.[2] ..... B65H 75/18; B65H 17/02

[58] Field of Search ..... 242/68.1, 68.4, 67.1 R, 242/73, 72, 68.3, 75.2, 72.1, 72 B, 68.5

[56] References Cited

UNITED STATES PATENTS

| | | | |
|---|---|---|---|
| 2,903,200 | 9/1959 | McDougall | 242/72 X |
| 3,381,912 | 5/1968 | Huck | 242/68.4 |
| 3,584,714 | 6/1971 | Ryswick | 242/72 X |
| 3,829,147 | 8/1974 | Ryswick | 242/72 |
| 3,841,580 | 10/1974 | Rodach | 242/75.2 |

*Primary Examiner*—Edward J. McCarthy
*Attorney, Agent, or Firm*—Karl F. Ross; Herbert Dubno

[57] ABSTRACT

An apparatus for winding and unwinding a band has a horizontal shaft extending from a housing and carrying on its end an array of rings in which noncompressible metallic rings alternate with elastomeric rings. Axial displacement of at least the end rings of the array compresses the elastomeric rings and expands them outwardly away from the shaft and into engagement with the interior of a coil being wound up or unwound on the extending end of the shaft. Hydraulic actuating means may simply move the two end rings toward one another to compress the entire array, or each of the noncompressible rings may be comprised of two parts and spreadable by hydraulic pressurization of a compartment between them to compress the elastomeric rings. The shaft may have a frustoconical end snugly receivable within a frustoconical socket mounted via bearings in the housing attached to a drive motor for interchangeability of the shaft.

10 Claims, 7 Drawing Figures

APPARATUS FOR WINDING AND UNWINDING A BAND

CROSS-REFERENCE TO RELATED APPLICATIONS

This application is related to the commonly assigned patent applications Ser. No. 512,604, now U.S. Pat. No. 3,924,428 and Ser. No. 581,767 filed Oct. 7, 1974 and Mar. 29, 1975, respectively, and themselves referring to commonly assigned U.S. Pat. Nos. 3,559,431, 3,722,776, and 3,777,532.

FIELD OF THE INVENTION

The present invention relates to an apparatus for winding and/or winding a band. More particularly this invention concerns a support apparatus for holding and rotating a heavy coil of sheet metal.

BACKGROUND OF THE INVENTION

In a sheet-metal rolling mill it is frequently necessary to roll a band of sheet metal up into a large-diameter coil that may weigh up to fifty tons, and at a later time to unroll this coil. Only in coil form can such bands of sheet metal be conveniently stored or warehoused temporarily between stretching, pickling, and other operations.

Thus it is necessary in such mills to provide devices for rolling up the sheet metal and for holding the rolled-up coils securely while they are being unrolled. Such an apparatus typically has a winding stem or core whose longitudinal axis extends horizontally and which is at least limitedly radially expansible. In this manner it is possible to expand the core to its maximum diameter prior to winding a band thereon so that the finished coil can be removed from the core readily once the diameter of this core has been reduced. The core may also be fitted into a wound-up roll and expanded so as tightly to hold this roll and to center it on the shaft axis.

To this end the core is usually subdivided along a plurality of axially extending planes into a plurality of angularly spaced segments that may be displaced radially from an outer position where all of the part-cylindrical outer surfaces of the segments lie on a common cylinder centered on the segment to an inner position. It is clear that in such an arrangement a generally cylindrical surface, albeit provided with angularly spaced gaps, is only formed in one position of the segments. It is therefore necessary to provide a separate core element for each difference size coil to be wound or unwound. Furthermore the gaps between the segments usually telegraph through at least the first layers of band wound around the core so that the end of the band when unwound carries a succession of transverse bends that often make this section of the band useless.

The several segments are often displaced radially by means of a complicated camming or lever arrangement between a horizontal support shaft and the segments. This reduces the maximum possible diameter of the support shaft so that a relatively weak structure is produced. Other mechanisms using complicated hydraulic arrangements or two-arm levers are also known, all being relatively complex and taking up considerable space within the support core.

It is also known to support this core at both ends, or to employ a two-part core for supporting the coil. Such mechanisms are considerably stronger than the above-described types, but are also much more expensive and prone to failure. Also in such systems, the changing of the internal diameter on the coil is a relatively complex procedure often requiring considerable downtime of the machine.

Another disadvantage of these devices is that the radially spreadable segments are not securely attached to the central support shaft. Thus when the core is rotated at high speed without a coil in place the segments can fly outwardly thereby ruining the machine and injuring a nearby machine operator.

Not only must the apparatus be able to support the roll, but it must frequently be able to exert on the roll tensions of up to twenty tons in order to stretch or roll the band properly. Thus it is necessary that the coil be securely joined to the core by forcing the radially spreadable segments very tightly against the inside of the coil so that the internal actuating mechanism for these segments must be rugged in the extreme. Another difficulty with such systems is that the heavy-duty actuating mechanism of each such core is so very complicated that changing of cores when different size coils must be held is a complicated operation requiring considerable time.

OBJECTS OF THE INVENTION

It is therefore an object of the present invention to provide an improved apparatus for winding and/or winding a band.

Another object is the provision of such an apparatus which is readily capable of supporting coils weighing fifty tons or more from only one side and for tensioning the band on the coil with a force of twenty tons or more.

Another object is the provision of such an appartus which may exactly fit within the coils having different internal diameters.

Yet another object is to provide an apparatus for holding a coil either during unwinding or winding thereof which is relatively simple and wherein the support core or shaft may readily be exchanged for one of smaller or larger diameter.

Yet another object is the provision of such an apparatus wherein the core may be rotated at extremely high speeds even when empty without any danger of the mechanism flying apart.

SUMMARY OF THE INVENTION

These objects are attained according to the present invention in such an apparatus wherein the shaft is provided with a plurality of axially spaced relatively noncompressible rings interleaved with a plurality of axially spaced and highly elastomeric rings. Means is provided for axially displacing the noncompressible rings to force them radially outwardly. These elastic rings each have a cylindrical inner periphery snugly engaging the shaft, a cylindrical outwardly directed outer periphery exposed between the noncompressible rings, and a pair of axial end faces at least one of which is axially engaged against a respective noncompressible ring.

In accordance with the present invention the noncompressible rings are made of metal, preferably steel, and the elastic rings are made of a natural or synthetic elastomer.

Thus with the system according to the present invention the outer surface of the support core is expanded by axial compression of the elastic rings it maintains a perfectly cylindrical outer shape. Furthermore due to the high coefficient of friction of such elastic rings the coil is rotationally locked to the shaft.

The means for axially compressing the elastic rings according to this invention may be an abutment ring at one end of the alternating array of compressible and noncompressible rings and another ring at the other end which is displaceable axially by hydraulic and/or mechanical means. The actuator may have a rod passing axially through the center of the support shaft and provided on its end distal from the ring array with a piston in a chamber that can be pressurized on either side by means of a rotary coupling connected to a source of fluid pressure.

In accordance with another feature of this invention each of the metal rings is formed of two overlapping L-section parts defining between themselves an annular compartment. The shaft within the ring array is formed with a plurality of radially extending passages each opening into one such compartment so as to force one of the parts away from the other and thereby compress the elastic rings.

In accordance with yet another feature of the present invention the apparatus has a housing in which is mounted via journals or bearings an axially centered frustoconical socket that is rotatable. The shaft has an end turned away from the end carrying the rings which is complementary frustoconically shaped and securable within this socket. A simple axially extending threaded shaft and a nut may lock the frustoconical end section in place in the socket, and a chamber at the far end of the section may be pressurized to drive it out for replacement.

According to yet another feature of the present invention two such devices are provided with their axes in line and each arranged to fit within an opposite end of the hole through the center of a core. Such an arrangement is particularly usable for heavy-duty setups where uncommonly large forces must be withstood.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
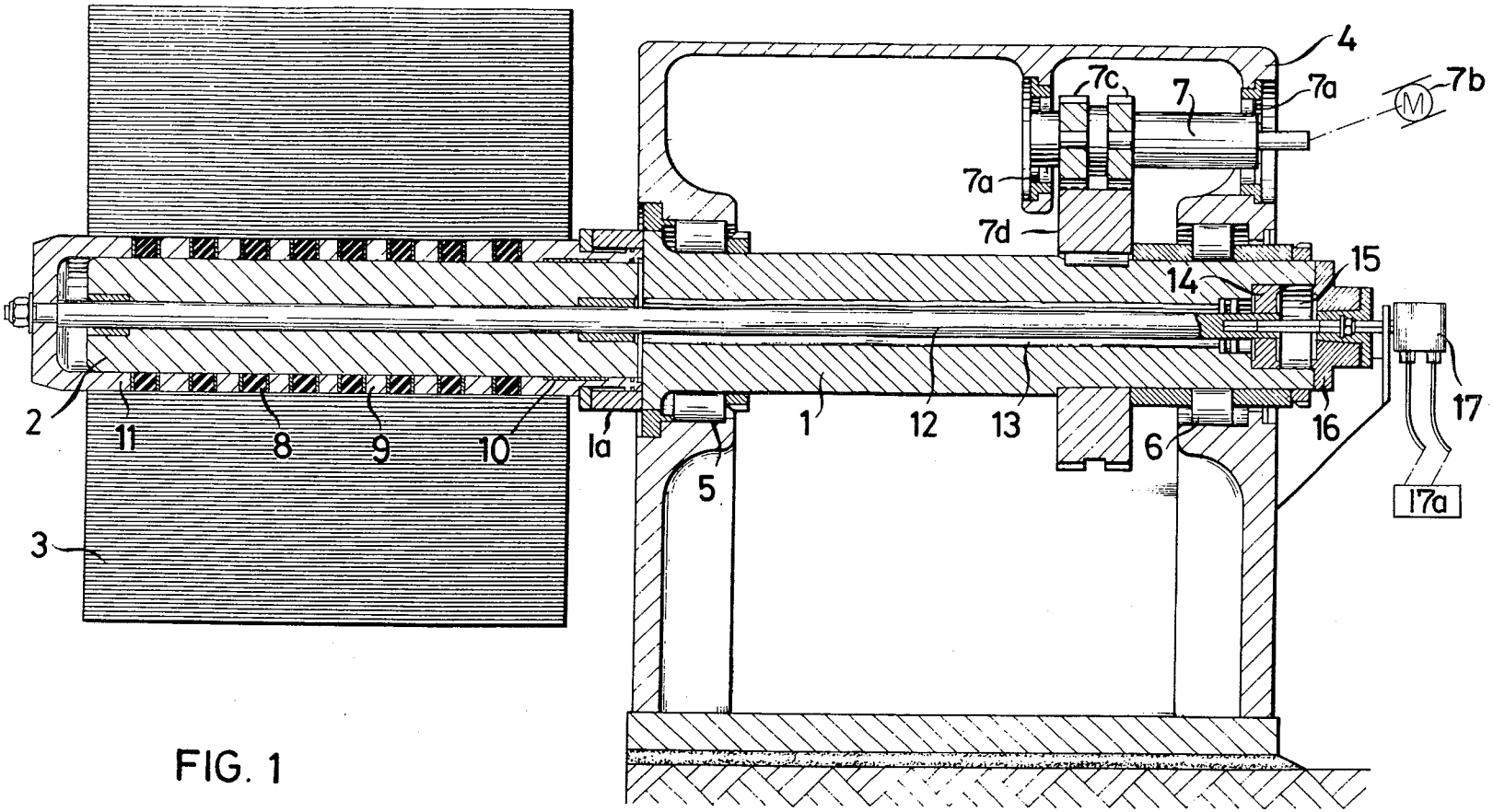
FIGS. 1 and 1A are axial sections through the apparatus according to the present invention.

The arrangement according to the present invention has a main support shaft 1 supported via bearings 5 and 6 in a fixed housing 4. This shaft 1 is generally tubular and defines a horizontal axis A. A second support shaft 2 linked to and coaxial with the shaft 1 extends from the housing 4 and supports a coil 3 of sheet steel. A drive shaft 7 secured via bearings **7*a* in the housing 4 is driven via a motor 7*b* keyed to the shaft 7. Gears 7*c* on shaft 7 drive the gear 7*d* keyed to shaft 1. Thus rotation of this shaft 7 rotates the shaft 1** in the opposite direction.

The shaft section 2 has a cylindrical outer surface and is provided externally with eight axially spaced and square-section elastomeric rings 8 having cylindrical inner and outer peripheries and flat axial ends provided with backing disks 18 vulcanized in place. Interleaved with these elastomeric rings 8 are seven square-section steel rings 9. The array of rings 8 and 9 is braced between an axially displaceable abutment ring 10 at the end toward the housing 4 and another ring 11 at the opposite axial end of the shaft section 2. A rod 12 extending through a longitudinal passage 13 in the shaft 1 has one end secured to the ring 11 and another end carrying a piston 14 reciprocal within a cylindrical compartment 15 at the end of the shaft section 1 remote from the shaft section 2. A coupling 16 allowing the shaft section 1 to rotate relative to a feed valve 17 is provided on this end of shaft section 1 and allows the compartment 15 to be connected to a source **17*a*** of pressure.

The shaft section 1 is formed at its end opposite the valve 17 with a cylinder **1*a* in which is reciprocal the end of the ring 10 and which is connected via the passage 13 with the chamber 15 to the side of the piston 14 opposite the valve 17**.

Figure 1A:
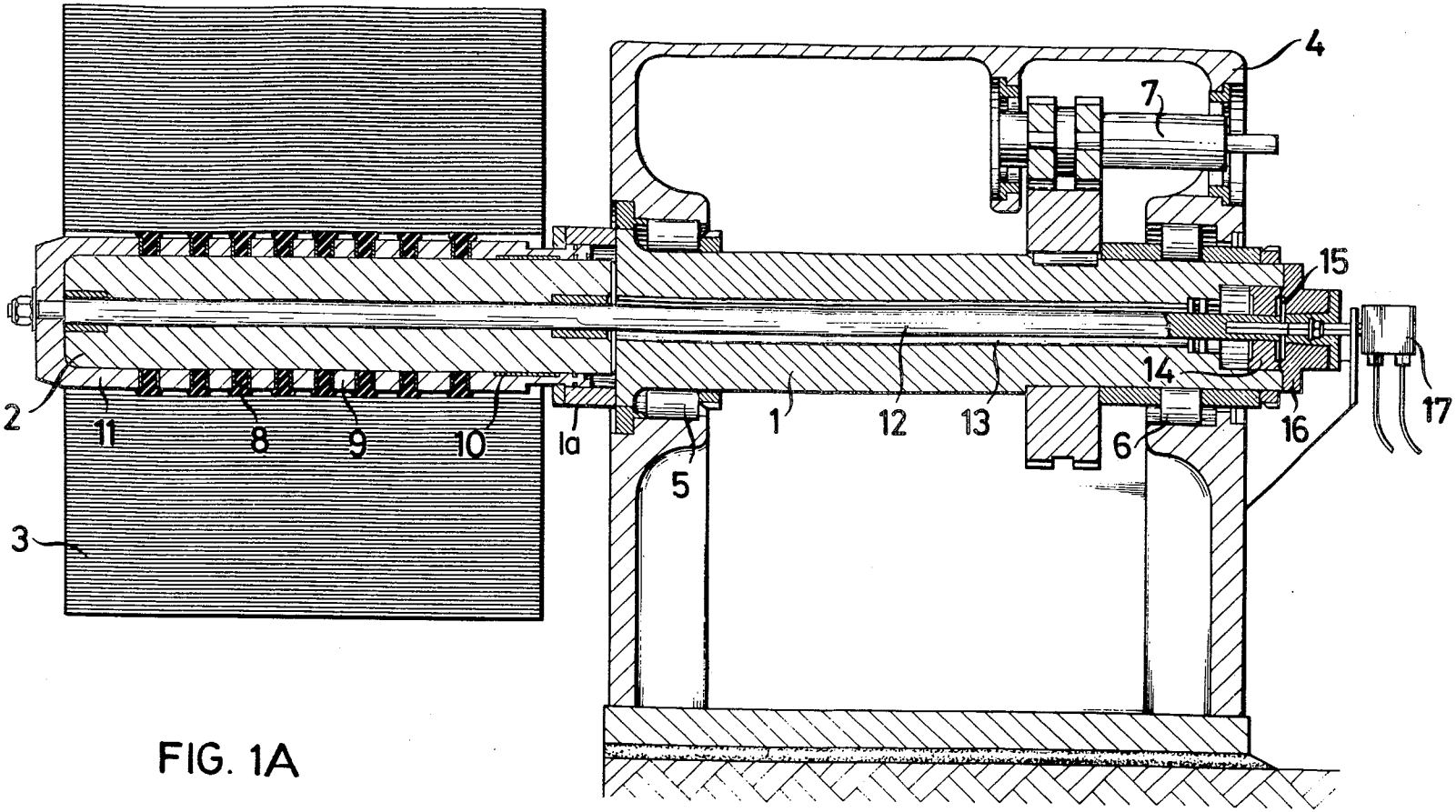

The apparatus functions as follows:

For winding up a coil 3 the right-hand side of the compartment 15 is pressurized so as axially to stretch the array of rings 8 and 9 as shown in FIG. 1. This gives the core shaft 2 minimum diameter. A few turns of the coil are then carefully wound around the shaft section 2. Thereupon the other side of the chamber 15 is pressurized so as both to force the piston 14 to the right, thereby pulling the ring 11 to the right, and to pressurize the interior of cylinder **1*a* so as to force the ring 10 to the left. This compresses the elastomeric rings 8 as shown in FIG. 1A and gives the shaft section 2 a larger outside diameter. The motor 7*b* is then operated to roll up a coil 3** of the desired diameter.

For unwinding of a coil the fully wound coil 3 is fitted over the shaft section 2 with the right-hand side of the chamber 15 pressurized so as to give this section 2 minimum diameter. Thereafter the left-hand side is pressurized to increase the diameter and rotationally lock the coil 3 to the shaft section 2.

Such an arrangement is usable with coils 3 having weights up to 30 to 40 kg/mm of width and having an overall weight of between 45 and 60 tons.

Figure 2:
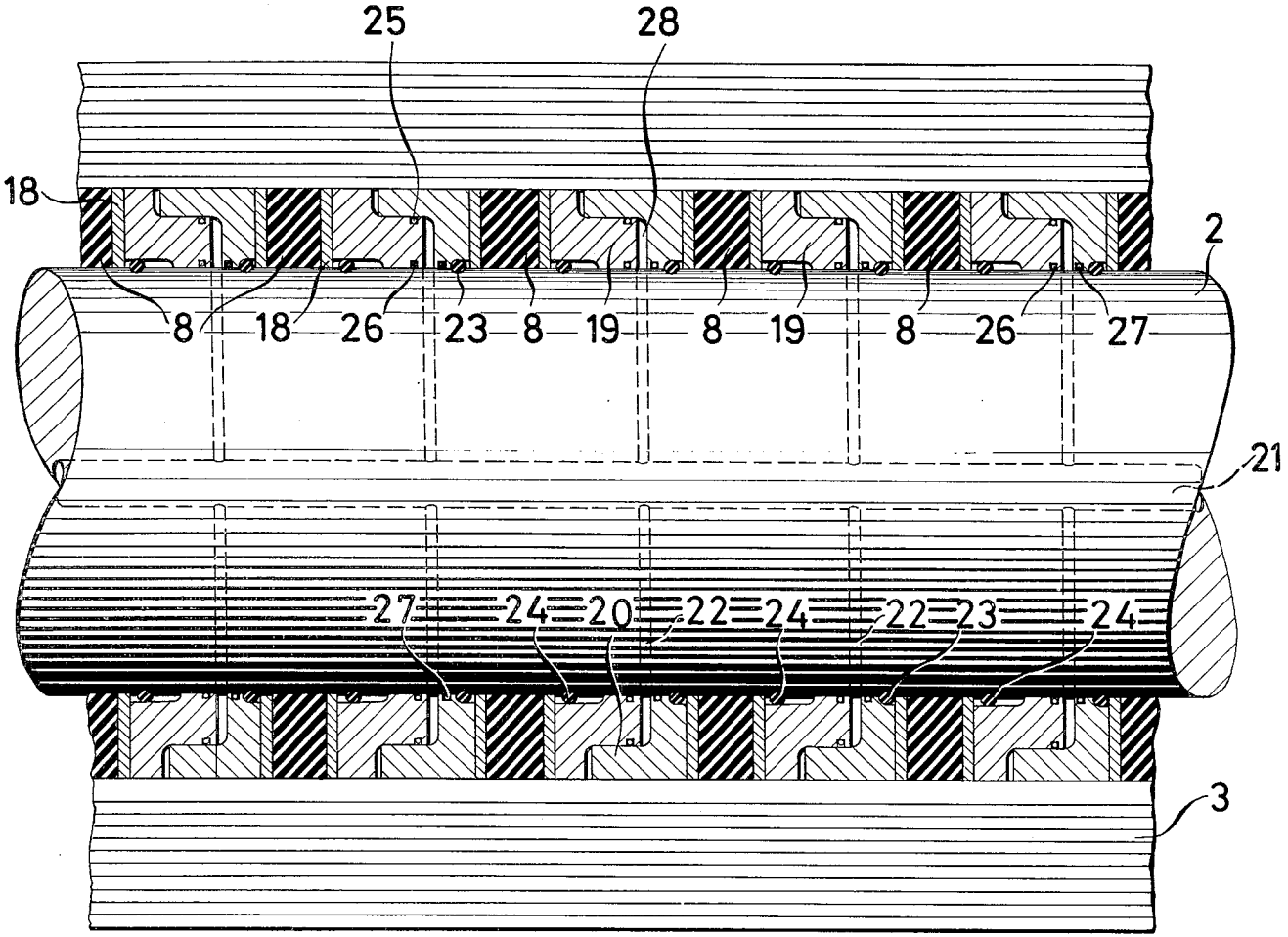
FIGS. 2 and 3 are large-scale axial sections through a detail of another arrangement in accordance with this invention in the minimum-diameter and maximum-diameter position, respectively.
Figure 3:
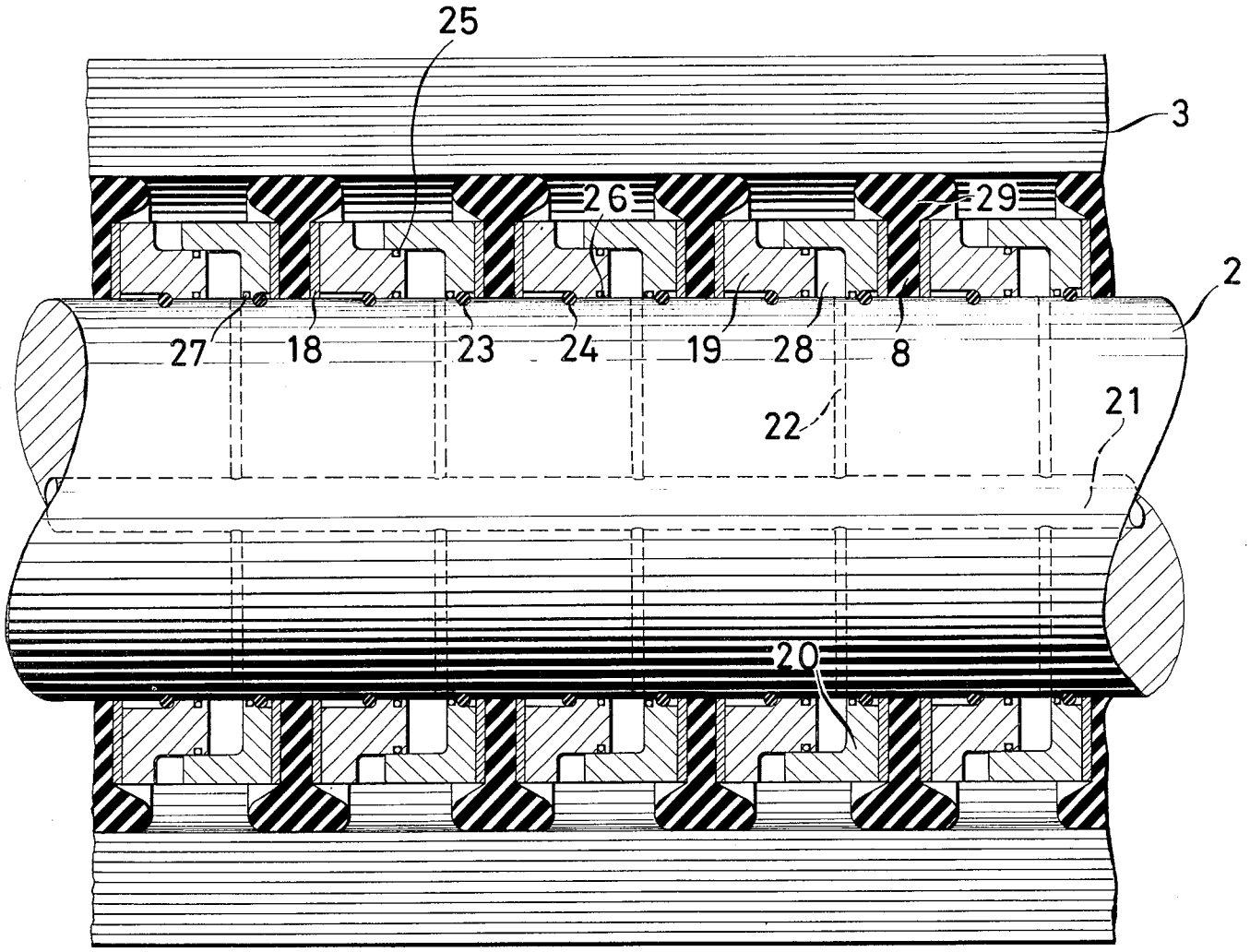

With the arrangements of FIGS. 2 and 3 the rings 9 are replaced by a pair of rings 19 and 20 each of generally L-shaped cross section and together defining a respective pressurizable compartment 28. The shaft 2 is formed with a central passage 21 connected via branch passages 22 to each of the compartments 28 for pressurization thereof. A snap ring 23 prevents displacement of each ring 20 whereas another snap ring 24 acts as an end stop for the other ring 19. O-rings 25, 26, and 27 seal each compartment 28.

Since the rings 8 are highly elastomeric, being made of a material such as a butadiene-acrylonitrile copolymer, and isobutylene-isoprene, polybutadiene, a styrene-butadine copolymer or the like, pressurization of the chambers 28 via the passages 21 and 22 forces the rings 8 to bulge outwardly as is shown at 29 in FIG. 3. This brings these rings tightly into contact with the inside of the coil 3.

Figure 4:
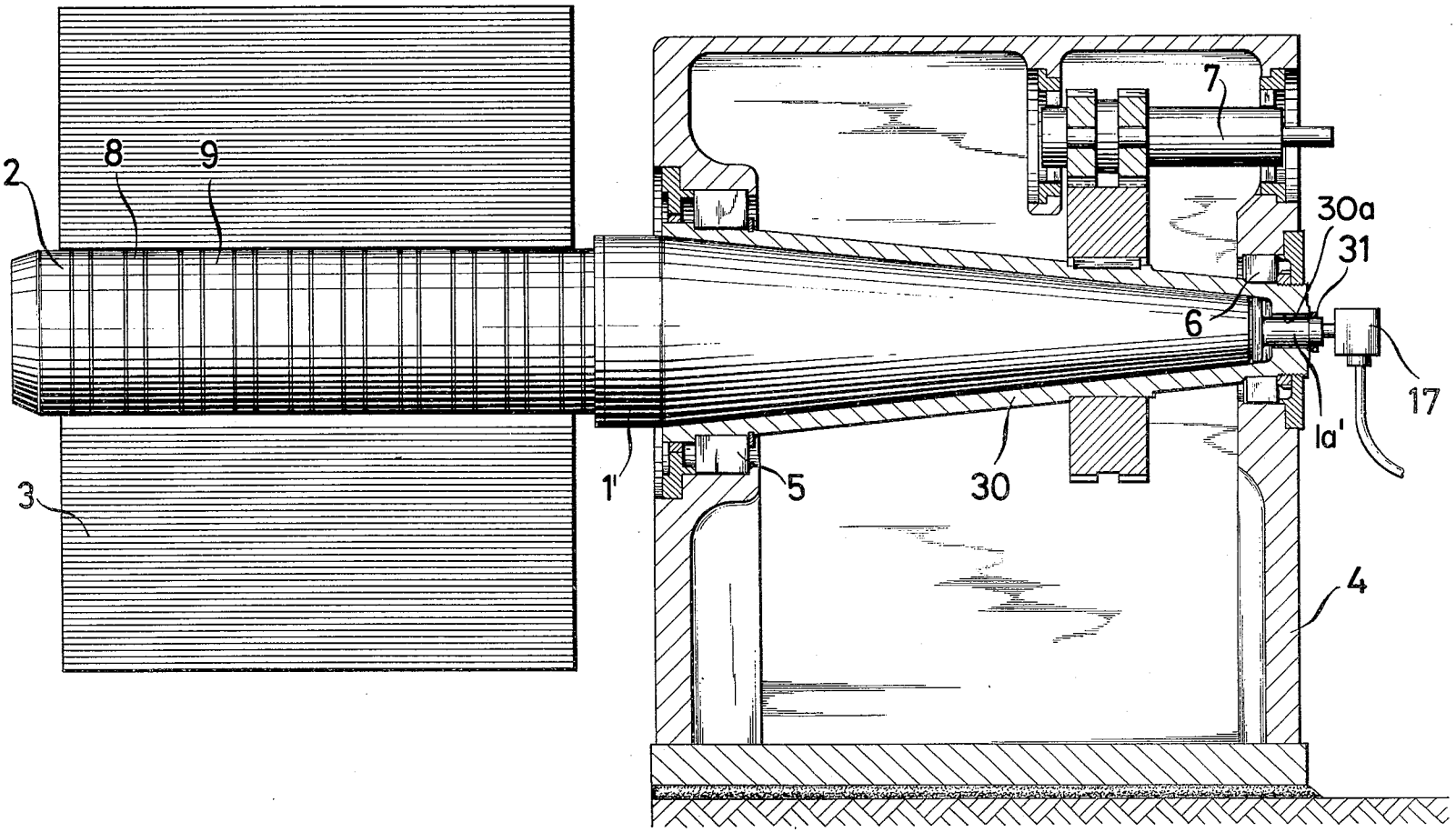
FIG. 4 is an axial section through another system in accordance with this invention.
Figure 5:
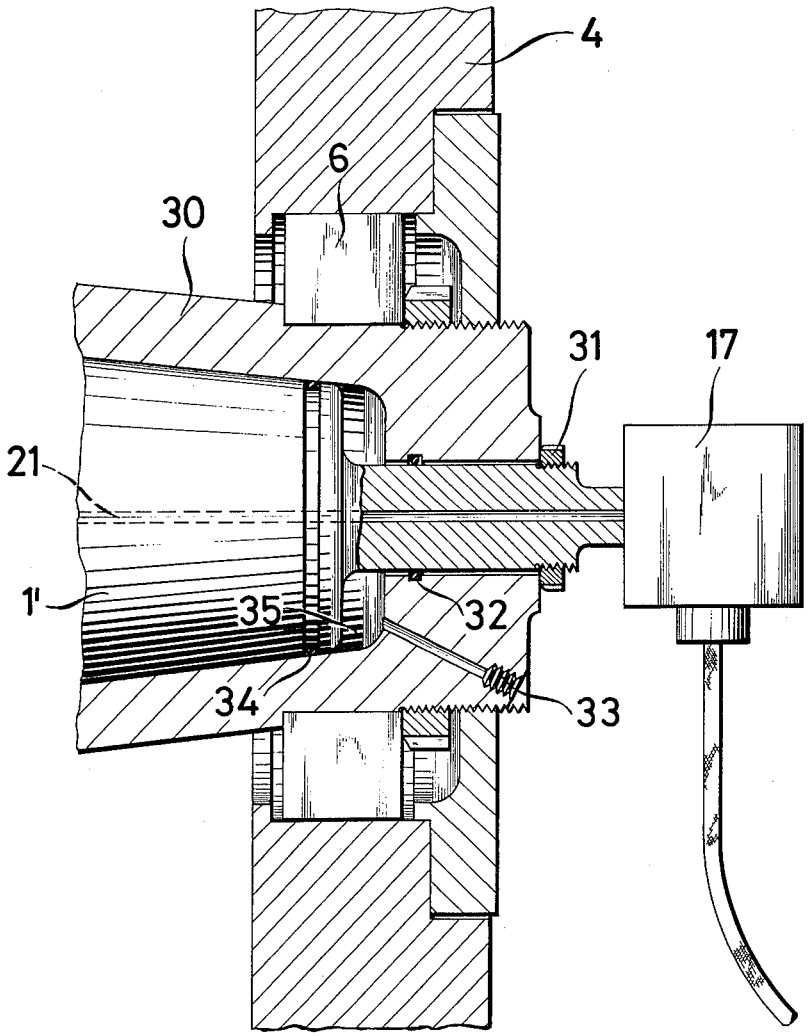
FIG. 5 is a large-scale view of a detail of FIG. 4.

The arrangement of FIG. 4 is substantially identical to that of FIGS. 2 and 3. Here however a shaft 1' is provided which is frustoconical and is received in a frustoconical socket 30 carried on the bearings 5 and 6 and connected to the drive shaft 7. At its end the shaft 1' has an extension 1*a'* which passes through a hole 30*a* lying on the axis and extending through the end of the socket 30. A nut 31 threaded over the extension 1*a'* locks the shaft 1' tightly in place. A pair of seals 32 and 34 prevent fluid leakage from a chamber formed at the base of the socket 30 and connectable via a passage 33 to a source of fluid pressure in order to aid in removing the shaft 1 from the socket 30. With this system changeover from one diameter shaft to another can be effected relatively quickly.

Figure 6:
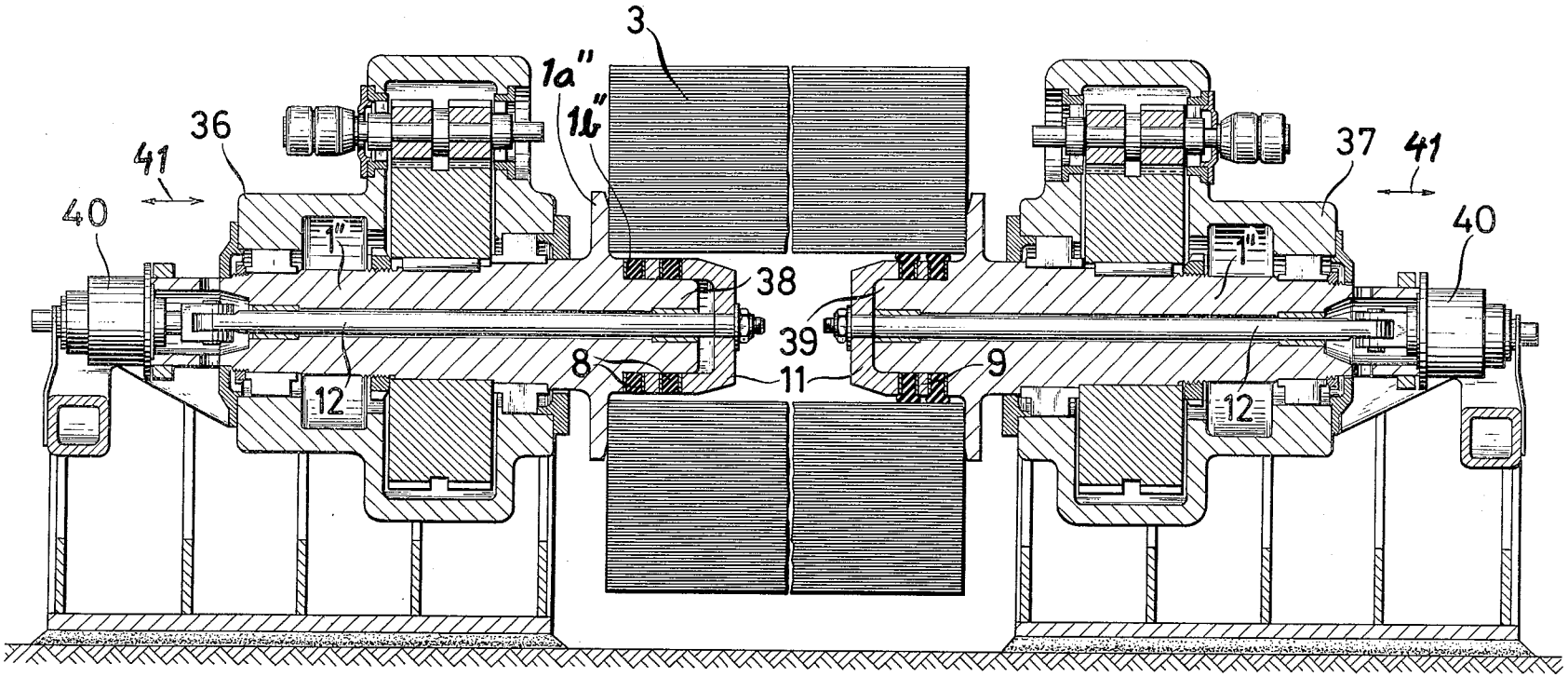
FIG. 6 is an axial section through yet another arrangement according to the present invention.

FIG. 6 shows an arrangement wherein a single coil 3 is supported on the ends 38 and 39 of a pair of shafts 1'' carried in respective housings 36 and 37. Each of these ends 38 and 39 has a pair of rings 8 compressible by an end ring 11 as described with reference to FIG. 1 and carried on an axially extending shaft 12. Furthermore each device has a respective actuator 40 at its far end so as to allow compression of these rings 8 as shown in FIG. 6 to the right, pressing the rings 8 against each other through the noncompressible ring 9 and against a shoulder 1*a''* formed on the shaft 1''. The coil 3 is received between flanges 1*b''* on the shaft 1''.

The two shafts 1'' are coaxial and the housings 36 and 37 are displaceable along the axes as indicated by arrows 41. This arrangement is used for large installations where extremely heavy rolls are being wound and unwound at very high pressures.

Although the arrangement described above were mentioned with particular application to sheet-steel rolling mills and the like, it is also possible to use these devices in the manufacture of textiles, paper and similar bands. The use of elastomeric rings allows even relatively delicate material such as very thin foils and the like to be tightly wound up by the device.

I claim:

1. An apparatus for winding a band, said apparatus comprising:

a support, a shaft having a longitudinal axis and rotatable on said support about said axis, a plurality of axially spaced relatively noncompressible rings surrounding said shaft, a plurality of axially spaced elastomeric rings surrounding said shaft and interleaved with said noncompressible rings, and means for axially displacing said noncompressible rings and thereby axially compressing said elastomeric rings to force same radially outwardly.

2. The apparatus defined in claim 1 wherein said elastomeric rings each have a radially inwardly directed inner periphery snugly engaging said noncompressible rings, and a pair of axially end faces at least one of which is engaged axially against a respective ring.

3. The apparatus defined in claim 2 wherein said rings form an array having a pair of axial ends each constituted by a respective such noncompressible ring, said means including a hydraulic cylinder arrangement and an axial extending rod connected to one of the end rings and to said arrangement.

4. The apparatus defined in claim 3 wherein said means further comprises a hydraulic cylinder arrangement connected directly to the other end ring.

5. The apparatus defined in claim 3 wherein said shaft has a central axially extending passage loosely receiving said rod and is formed with a pressurizable chamber communicating with said passage, the first-mentioned arrangement including a piston on said rod in said chambers.

6. The apparatus defined in claim 2 wherein at least one of said noncompressible rings has a pair of parts exially displaceable relative to each other and forming a pressurizable compartment.

7. The apparatus defined in claim 6 wherein said parts are annular and at least one of them is of L-section and overlaps the other.

8. The apparatus defined in claim 7 wherein one of said parts is axially fixed on said shaft.

9. The apparatus defined in claim 2 wherein said housing has a frustoconical socket rotatable about said axis and said shaft has a frustoconical end section removably receivable in said socket.

10. The apparatus defined in claim 2, further comprising another such support, shaft elastomeric and noncompressible rings, and means, said shafts being coaxial and said other support being axially displaceable relative to the first-mentioned support.

* * * * *